United States Patent [19]

Romano

[11] 4,083,395

[45] Apr. 11, 1978

[54] ACOUSTIC DRAPE

[76] Inventor: Paul L. Romano, 2902 Quincy Ave., Orange, Calif. 92667

[21] Appl. No.: 716,082

[22] Filed: Aug. 20, 1976

[51] Int. Cl.[2] ..... A47H 1/00

[52] U.S. Cl. ..... 160/84 R; 160/330

[58] Field of Search ..... 160/84 R, 84 V, 84 H, 160/330; 181/336, 336 B

[56] References Cited

U.S. PATENT DOCUMENTS

| | | | |
|---|---|---|---|
| 2,293,351 | 8/1942 | Meginnity | 181/33 G |
| 2,802,764 | 8/1957 | Slayter et al. | 181/33 G |
| 2,903,055 | 9/1959 | Merrill | 160/84 H |
| 3,223,147 | 12/1965 | Holloway | 160/84 H |
| 3,234,996 | 2/1966 | King et al. | 181/33 GB |
| 3,628,626 | 12/1971 | Merrill | 160/84 H |

*Primary Examiner*—Peter M. Caun

*Attorney, Agent, or Firm*—Gausewitz, Carr & Rothenberg

[57] ABSTRACT

An acoustic drape is formed of a continuous plastic barrier sheet upon which panels of acoustic foam are mounted at spaced intervals to define narrow optically transparent hinge sections between the panels. The panels are loosely mounted within sleeves fixed to the sheet to accommodate differences in thermal expansion, and yet are sufficiently confined to provide physical support for the thin plastic barrier sheet.

2 Claims, 9 Drawing Figures

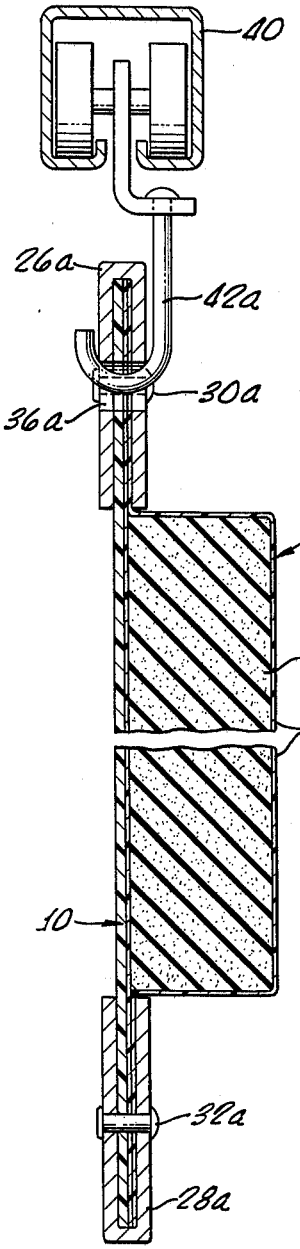
FIG. 4.
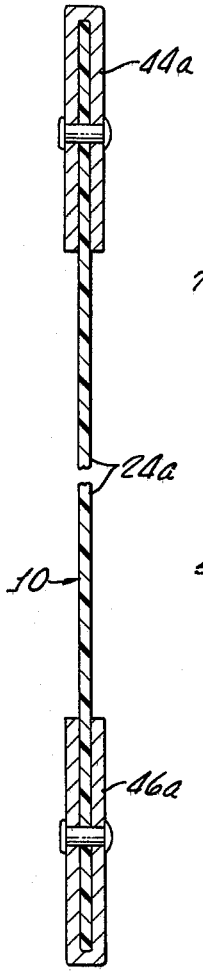
FIG. 5.
FIG. 9.
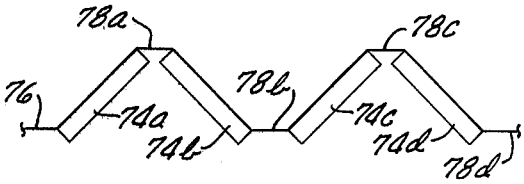
FIG. 6.
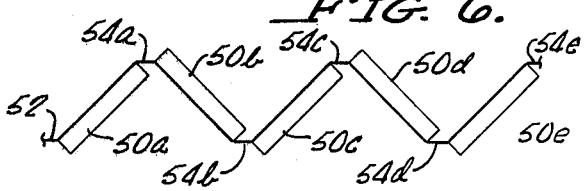
FIG. 7.
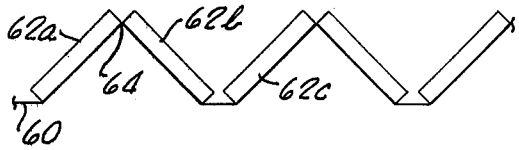
FIG. 8.
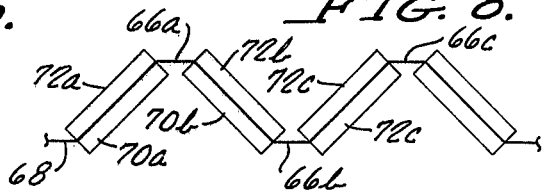
FIG. 3.
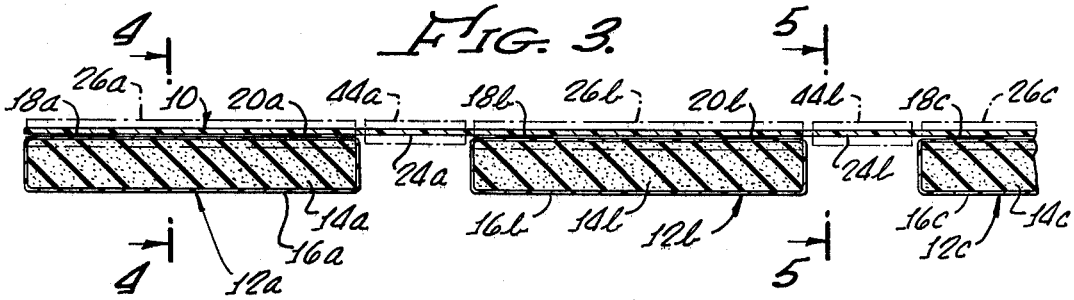

ACOUSTIC DRAPE

BACKGROUND OF THE INVENTION

The present invention relates to acoustic barriers and more particularly concerns a simple and inexpensive acoustic drape that provides both a sound transmission barrier and sound absorption.

Movable sound barriers presently in use include two general categories. These are the rigid panel accordion-like folding door arrangement carried on lazy tongue structures and a more flexible drapery arrangement hung from standard drapery hardware. The folding door arrangements are, in general, expensive and complex structures, often employing multiple layers of different materials and relying on the mass of these, at least in part, to provide a barrier to sound transmission.

Sound absorptive draper systems have employed either multiple back-to-back drapes with sound absorber material contained between them or have provided drapes of heavy massive material for increased sound absorption. Both multiple drape systems and massive drape material systems are expensive to fabricate and difficult to install, requiring special tracks and hardware for spaced support of multiple layers.

In sound barriers of the prior art, no provision has been made for optical transparency. Thus, when such devices are positioned for sound absorption it is not possible to see from one side of the barrier to another. In many applications, such as temporary enclosures for convention booths or enclosures for noise generating industrial equipment, it is desirable or necessary to both limit sound transmission and maintain visual communication across the sound barrier. Applicant knows of no prior movable sound barrier systems that provide any useful optical transparency.

Accordingly, it is an object of the present invention to provide a simple, inexpensive and effective sound barrier system that avoids or minimizes above mentioned problems.

SUMMARY OF THE INVENTION

In carrying out principles of the present invention in accordance with a preferred embodiment thereof, an acoustic drape is formed of a flexible acoustic barrier sheet and a plurality of acoustic absorber means is secured to the sheet in mutually spaced relation. At least some of the absorber means comprise an absorber pocket attached to the barrier sheet and a body of sound absorber material within the pocket. According to a feature of the invention, the barrier sheet between the absorber pocket provides elongated transparent hinge sections of the drape. The thin, flexible and nonself-supporting barrier sheet is enabled to hang in a useful zig-zag configuration by physical support derived from resilient and semi-rigid absorber panels that are relatively loosely secured to the barrier sheet by being confined within the absorber pockets secured to the sheet.

BRIEF DESCRIPTION OF THE DRAWINGS

FIG. 3 is a sectional view of a portion of the drape of FIG. 1 showing upper edge reinforcement in phantom lines;

FIG. 4 is a vertical section, with parts broken away, taken on lines 4—4 of FIG. 3;

FIG. 5 is a vertical section, with parts broken away, taken on lines 5—5 of FIG. 3; and FIGS. 6, 7, 8 and 9 schematically illustrate alternate configurations of mounting of absorber panels and sleeves upon the barrier sheet.

DETAILED DESCRIPTION

Figure 1:
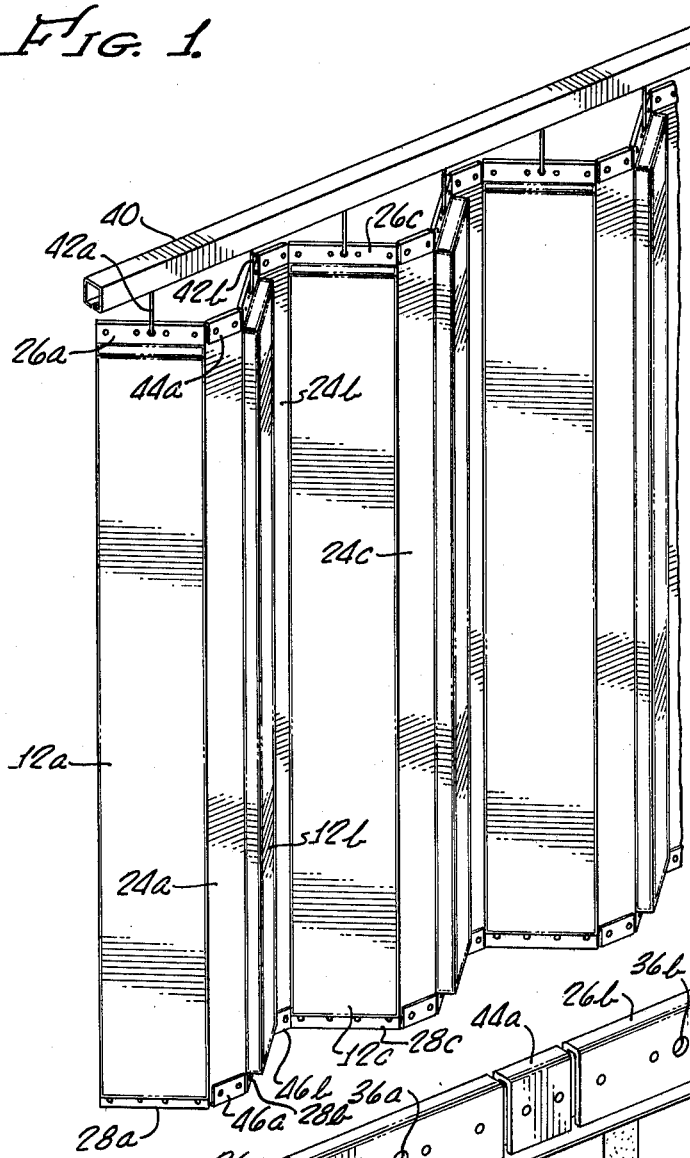
FIG. 1 is a perspective view of a portion of an acoustic drape embodying principles of the present invention.
Figure 2:
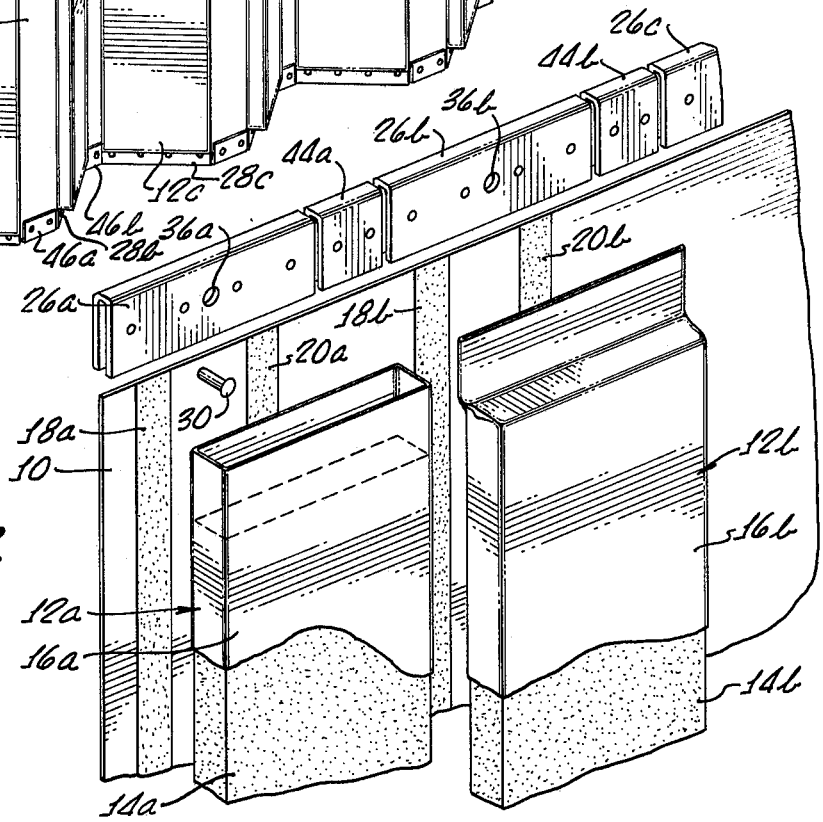
FIG. 2 is an exploded perspective view of components of the drape system of FIG. 1.

As shown in FIGS. 1 and 2, an acoustic drape embodying principles of the present invention incorporates an acoustic barrier sheet 10 and a plurality of mutually spaced elongated acoustic absorber means **12*a*, 12*b*, 12*c*, etc. secured to the sheet in mutually spaced relation. The barrier sheet 10** preferably comprises a relatively thick, flexible, continuous sheet of a suitable plastic material such as polyethylene or polyvinyl of at least 8 mils thickness. A preferable thickness is in the range of 10 to 30 mils.

The absorber means basically comprises a resilient, shape retaining semi-rigid foam material having open cells therein. Any one of a number of conventional acoustic type foam materials may be employed such as, for example, a material known as Scott Pyrel foam which is a polyester urethane foam preferably having a density of about two pounds per cubic foot. Other polyester and polyether urethane foams and other semi-rigid or self-supporting foam materials may be employed.

The absorber foam material is formed into elongated panels **14*a*, 14*b*, etc. of a cross section of approximately 1 inch by 6 inches and extending almost the entire length of the drape. These semi-rigid foam panels are to be secured substantially for their full length to the thin, flexible and nonself-supporting barrier sheet 10. The latter is nonself-supporting in that it does not maintain any pre-selected configuration and thus, if the drape is to be folded in an accordion-type pleated manner, some means is necessary to provide a structural or physical integrity or stiffening to the nonself-supporting plastic barrier sheet 10**.

Although the semi-rigid acoustic foam panels **14*a*, 14*b*, etc. are to be secured in a structurally supportive relation to the flexible barrier sheet, the panels and barrier sheet may be of different materials and thus they may have different coefficients of expansion. Accordingly it is desirable to provide such a connection between the panels and barrier sheets that will afford a structurally supportive relation to stiffen the barrier sheet and yet prevent distortion such as curling and the like that would result from a large differential in the coefficients of expansion of the materials of barrier sheet and acoustic absorber panels. Thus, thin tubular absorber panel sleeves or pockets 16*a*, 16*b*, etc. are formed to snugly envelop the respective individual absorber panels 14*a*, 14*b*, etc. Sleeve 16*a* is shown in FIG. 2 in a configuration that it assumes before its upper edges are secured to the barrier sheet. Sleeve 16*b* is shown in this figure in its final configuration. These sleeves or pockets 16*a*, 16*b*, etc. are secured to the barrier sheet in mutually spaced relation to each other by adhesive means 18*a*, 20*a*, 18*b*, 20*b***, etc. as best seen in FIGS. 2 and 3. The adhesive may be of any suitable type, chosen according to the materials employed and, for example, may be a strip of adhesive tape having adhesive on both sides thereof and extending for the full length of the respective sleeves. Preferably two separate strips of adhesive are used for each sleeve, positioned at two laterally spaced portions of the rear side of the sleeve.

The material of the sleeves 16*a*, 16*b*, etc. may be a thin plastic having a thickness in the order of 1 to 4 mils, preferably about two mils. This material preferably is acoustically transparent, and where it is a non-reticulated or non-porous material such as plastic, must be sufficiently thin so that it will readily transmit sound to the absorber panels confined within the sleeves. The sleeves may also be formed of other thicker materials that readily transmit sound, such as burlap, felt or velvet. The choice of material for the absorber panel sleeves is governed to a large extent by the nature of the use of the drapes and the desired appearance. Thus, for industrial applications, a two mil plastic material for the sleeves is preferred and this material may be readily imprinted with suitable designs or other matter as deemed appropriate. For use in homes or offices, a material more aesthetically pleasing, such as felt or velvet, or other type of aesthetically pleasing fabric, may be employed for the sleeves.

Conveniently plastic tubing having a 2 mil wall thickness may be cut into proper length and employed for the sleeves. Alternatively, rectangular sections of the appropriate sleeve material may be laid flat upon a horizontal supporting surface the the cellular absorber panel may be placed upon the flat sleeve material. The latter may then be folded over the now upper side of the foam panel with longitudinal edges overlapping and secured to each other as by a suitable adhesive such as a contact cement or the like. It is not necessary to close the upper and lower ends of the sleeves after the semi-rigid absorber panels have been inserted since these initially open upper and lower ends of the sleeves (see sleeve 16*a* of FIG. 2) will be secured in closed relation (see sleeve 16*b* of FIG. 2) by means to be described hereinafter.

Preferably the foam panels 14 are not secured or attached to the sleeves 16 but merely confined therein and completely covered by the sleeves (when upper and lower ends of the latter are closed). Thus, the panels may shift to some extent relative to the sleeves and, therefore, relative to the barrier sheet. Nevertheless, the panels still provide a physical integrity and structural support for the flexible barrier sheet itself.

As previously mentioned, the absorber panel sleeves together with the absorber panels confined therein, are secured to the barrier sheet 10 in mutually spaced relation and thus define therebetween barrier sheet hinge sections 24*a*, 24*b*, 24*c*, etc. The width of these hinge sections, as measured from one absorber panel sleeve to the adjoining absorber panel sleeve, may be varied as deemed necessary or desirable in accordance with a particular configuration of the drape as will become apparent in connection with the description of FIGS. 6 through 9 below. In general, however, if the drape is to be folded in an accordion pleated fashion with the panel sections pressed one against the other, at least alternate ones of hinge sections 24*a*, 24*b*, 24*c*, etc. must have a width sufficient to allow folding of the barrier sheet together with the absorber panel confining sleeves about the hinge section with the sleeves and panels in face-to-face abutment and confined between adjacent folded sections of the barrier sheet. Thus, where the absorber panels have a thickness of approximately one inch, the width of at least alternate hinge sections 24*a*, 24*b*, etc. preferably will be just over two inches.

Upper and lower ends of the pockets or sleeves 16*a*, 16*b*, etc. may be secured together in any suitable manner. Preferably, these upper and lower ends extend beyond the upper and lower ends of the respective absorber panels and are received within in short rigid or semi-rigid metal or plastic channel sections 26*a*, 28*a*, 26*b*, 28*b*, 26*c*, 28*c*, etc. at upper and lower edges of the drape. The sleeves are secured to the channel sections by suitable fastening means such as a plurality of rivets 30 extending through the walls of the reinforcing strips 26, 28 through the upper and lower edges of the barrier sheet 10 and through the upper and lower ends of the several absorber panel sleeves 16*a*, 16*b*, etc.

The reinforcing strips perform several functions. They help to secure the panel sleeve to the absorber sheet. They stiffen and reinforce the upper and lower edges of each section of the drape and, having preformed apertures 36*a*, 36*b*, etc. formed therein, provide a convenient arrangement for securing the drape to a conventional overhead track 40 having a number of slidable carriers 42*a*, 42*b*, etc. that have depending hooks engaged within the support apertures 36*a*, 36*b*, etc.

Since the hinge sections 24*a*, 24*b*, etc. of the barrier sheet are relatively wide, in the order of two inches in certain embodiments, and further, since the barrier sheet itself is thin, flexible and nonself-supporting as described above, it is desirable in some arrangements to prevent buckling of these hinge sections. To this end, upper and lower edges of each of the hinge sections have short strips of stiffening or reinforcing channel shaped metal or plastic 44*a*, 46*a*, 44*b*, 46*b*, etc. secured to upper and lower edges thereof. Reinforcing strips 44, 46 are spaced from panel section reinforcing strips 26, 28 to allow accordion type folding of the drape.

In various applications, at least portions of the drape should be optically transparent. For example, in a conveyor that moves empty metallic or glass containers to a filling station, it is highly desirable to surround the conveyor with an acoustic barrier that confines the noise of the moving containers and yet enables visual inspection of the line to identify areas at which flow of the containers is disturbed, obstructed or prevented. Transparency of the entire drape is not needed for such a purpose but some optical transparency is required and must be provided.

According to a significant feature of the present invention, the described arrangement readily adapts itself to providing optical transparency in usefully significant areas of the drape. To this end, at least those portions of the barrier sheet that form the hinge sections, are made to be optically transparent. Most conveniently, in order to provide the intermittently transparent drape, the barrier sheet is formed of an optically clear and transparent thin plastic material such as a clear polyethylene or clear vinyl of at least 8 mils thickness. Thus the drape will have nearly full length optically clear vertical windows of about a two inch width having a center-to-center spacing of approximately eight inches when the drape is fully extended. In normal use the drape is partly folded, in a zigzag shape, and thus the optical windows are closer to each other. Of course, if optical transparency is not desired, the window areas may be made opaque in any suitable manner, or the entire barrier sheet may be formed of an opaque material.

The described drape provides an effective sound barrier, providing both sound transmission loss by means of the barrier sheet 10 and a significant amount of sound absorption by means of the acoustic foam panels 14. As previously mentioned, the latter are operable to absorb sound even though they are completely enclosed within sleeves 16, because the latter are formed of a sound transmitting material.

The sleeves 16 perform several different functions. They transmit sound to the absorber panels. They provide a means of securing the absorber panels to the barrier sheet in a manner sufficient to allow the semi-rigid panels to provide structural support to the non-structural barrier sheet and, in addition, the sleeves provide protection of the open cell absorber material. Such absorber material, if not covered, will absorb dust and, in industrial environments, oil and other materials which collect in the pores and upon the surface of the material. This creates a fire hazard even though the absorber material itself may be flame resistant. The sleeves, furthermore, provide a simple, inexpensive and quick method of securing the acoustic foam panels to the barrier sheet to achieve the desired cooperative relation between the panels and the sheet.

As illustrated in FIG. 1, the drape is suspended from the slidable carriers of a conventional overhead drapery track and will normally be positioned when in use in a semi-folded position so that the drape assumes a somewhat zigzag configuration as viewed in horizontal section. The smaller the angle between adjacent zigzag panels, the greater the amount of absorptive material available for sound suppression and thus the greater effectivity of the drape. Of course, a greater gross horizontal length of drape is required for such a greater density of panel sections.

Although the embodiment illustrated above shows absorber panels in a relatively regular configuration and all upon one side of the barrier sheet, it will be readily appreciated that different environmental conditions and applications may usefully employ many other different arrangements and configurations of a barrier sheet having a number of sleeves secured thereto, each confining and acoustic absorber panel. Some exemplary modifications of arrangement and configuration of the drape of FIGS. 1, 2 and 3 are illustrated in the schematic drawings of FIG. 6 through 9. It will be readily appreciated that specific details of constructions of the arrangements of FIGS. 6–9 will be identical to the corresponding details of construction of the embodiment of FIGS. 1–5, differing only in the particular location of absorber panel filled sleeves upon the barrier.

In FIG. 6 panel filled sleeve assemblies 50*a*, 50*b*, 50*c*, 50*d*, 50*e*, etc. are mounted upon opposite sides of the barrier sheet 52, panel assembly 50*a* being on one side, panel assembly 50*b* being on the opposite side, panel assembly 50*c* being on the same side as 50*a*, etc. This arrangement allows use of a shorter width of hinge sections 54*a*, 54*b*, 54*c* between adjacent panel sections and still enables complete accordion folding of the drape. Thus the hinge sections 54 of the arrangement of 56 may have only a one inch width (with a one inch thickness of semi-rigid foam panels). This arrangement provides greater sound absorption but decreases optical transparency.

Illustrated in FIG. 7 is another arrangement which provides even folds but with absorptive panels all on one side of the barrier sheet 60. Panels 62*a*, 62*b*, 62*c*, etc. are secured to the barrier sheet 60 just as in the previously described embodiment except that in this arrangement panels of a first pair of panels are spaced from each other by a distance considerably less than the spacing between panels of a second pair of panels. Thus panels 62*a* and 62*b* have a relatively small space between them providing a very narrow hinge section 64 whereas the next pair of panels, panels 62*b* and 62*c*, are spaced from each other by a distance substantially equal to the thickness of the two panels (approximately 2 inches in the described embodiment) and thus the accordion folding of all panels may be achieved.

Illustrated in FIG. 8 is an arrangement which provides even folds and regularly spaced equal width hinge sections 66*a*, 66*b*, 66*c*, etc. of the barrier sheet 68. In this arrangement, to afford absorption on both sides of the drape, panel assemblies 70*a*, 70*b*, 70*c*, etc. all are affixed to the barrier sheet 68 on one side thereof and identical barrier assemblies 72*a*, 72*b*, 72*c* all are fixed to the barrier panel on the opposite side thereof, directly opposite the corresponding barrier panel assemblies 70. With this arrangement, the drape will more effectively absorb sound that is transmitted toward it from either side. In those arrangements (FIGS. 7 and 9) where absorber panels are all mounted on one side of the barrier sheet, the drape will primarily reflect sound impinging upon the side of the barrier having no absorber panels and will primarily absorb sound impinging upon the other side. In all cases the drape provides both a barrier to transmission of sound through the drape, in either direction, and absorption of sound propagated toward that side or sides upon which the absorber panels are positioned. The transmission barrier is afforded largely by the barrier sheet, and absorption largely by the absorber panels.

For applications where vision through the drape is desired, the panels are arranged as illustrated in FIG. 9 wherein panel assemblies 74*a*, 74*b*, 74*c*, etc. are all arranged to provide absorption on one side only. Thus the panels are all connected to the same side of the barrier sheet 76 and equal width regularly positioned hinge sections 78*a*, 78*b*, 78*c*, etc. are defined between the regularly spaced adjacent panel assemblies 74. This is the same as the arrangement of FIGS. 1–5.

In the arrangement of FIG. 9, the drape is normally positioned in use in a partial folded and somewhat zigzag configuration. This is the same zigzag configuration of all of the embodiments when in normal use. Such a configuration of the drape of FIG. 9 provides a relatively wide window 78*b* between panel assemblies 74*b* and 74*c* and a relatively wide window 78*d* between panel assemblies 74*d* and the next adjacent panel by virtue of the complete transparency of the barrier sheet 76. The nature of the zigzag folds cuts down on the effective window width of transparent sections 78*a* and similar alternate hinge sections. However, the alternate wider viewing paths provided by hinge sections 78*b*, 78*d*, etc. are adequate to provide satisfactory optical transparency of the drape.

If deemed necessary or desirable, vertically extending ends of the drape may be reinforced with stiff, rigid or semi-rigid strips of suitable material to facilitiate moving or connection of the drape and drape ends. Such rigid vertically extending reinforcing end strips or other equivalent means may be employed to permanently or temporarily and detachably interconnect adjacent lengths of the drape so that the latter may be made in relatively shorter sections to provide a single overall length greater than any individual length of drape.

The described drape, particularly because of its simplicity, aesthetic appearance, economy of manufacture, light weight, and effectivity of sound absorption, may be used in a wide variety of applications, including use as office partitions, hospital bed curtains, backing for existing drapes, against building walls to create an absorptive plenum between the wall and folded drape, for noise isolation in convention booths, for window curtains to minimize entrance of outside noise, for sound isolation booths around noise-producing industrial apparatus such as certain processing equipment, conveyors and machines such as typewriters, telex equipment and computers. Where the drapes are made in relatively short sections, detachably interconnected to each other, they will provide both visual access and physical access in a most convenient manner.

The foregoing detailed description is to be clearly understood as given by way of illustration and example only, the spirit and scope of this invention being limited solely by the appended claims.

I claim:

1. An optically transparent acoustic drape comprising a flexible, optically transparent acoustic barrier sheet of non self-supporting material that does not maintain any preselected configuration, and means for providing sound absorption, physical integrity and structural support for said sheet, said means comprising, a plurality of absorber sleeves directly secured to said barrier sheet in mutually spaced relation to define optically transparent drape hinge sections therebetween, said sleeves being formed of an acoustically transparent protective material, and a plurality of semi-rigid self-supporting panels of acoustic absorber material, each being snugly but movably confined within a respective one of said sleeves, whereby said sleeves permit relative motion of said panels and said barrier sheet but allow said panels to support said barrier sheet.

2. The drape of claim 1 wherein said barrier sheet sections form the sole hinging interconnection between adjacent absorber sleeves.

* * * * *